US009193493B2

(12) United States Patent
Pace

(10) Patent No.: US 9,193,493 B2
(45) Date of Patent: Nov. 24, 2015

(54) LABELLING MACHINE

(75) Inventor: Raffaele Pace, Parma (IT)

(73) Assignee: SIDEL S.p.A. (IT)

( * ) Notice: Subject to any disclaimer, the term of this patent is extended or adjusted under 35 U.S.C. 154(b) by 475 days.

(21) Appl. No.: 13/636,456

(22) PCT Filed: Mar. 22, 2010

(86) PCT No.: PCT/IT2010/000124
§ 371 (c)(1),
(2), (4) Date: Nov. 30, 2012

(87) PCT Pub. No.: WO2011/117895
PCT Pub. Date: Sep. 29, 2011

(65) Prior Publication Data

US 2013/0153150 A1 Jun. 20, 2013

(51) Int. Cl.

| | |
|---|---|
| ***B65C 9/04*** | (2006.01) |
| ***B65C 9/18*** | (2006.01) |
| ***B65C 3/06*** | (2006.01) |
| *B65C 9/00* | (2006.01) |

(52) U.S. Cl.
CPC . *B65C 9/04* (2013.01); *B65C 3/065* (2013.01); *B65C 9/00* (2013.01); *B65C 9/1815* (2013.01); *B65C 9/0065* (2013.01)

(58) Field of Classification Search
CPC ..... B65C 9/0065; B65C 9/04; B65C 9/1815; B65C 9/1826; B65C 3/065
USPC ..... 156/556, 567, 568
See application file for complete search history.

(56) References Cited

U.S. PATENT DOCUMENTS 7,870,882 B2 1/2011 Panzetti

FOREIGN PATENT DOCUMENTS

| | | | |
|---|---|---|---|
| JP | 56-048938 | A | 5/1981 |
| JP | 2005-536414 | A | 12/2005 |
| WO | WO-2004/020291 | A1 | 3/2004 |

OTHER PUBLICATIONS

"International Application Serial No. PCT/IT2010/000124, International Preliminary Report on Patentability dated Sep. 25, 2012", 5 pgs.
"Japanese Application Serial No. 2013-500658, Office Action mailed Jan. 7, 2014", (English Translation), 2 pgs.
"Machine Translation of JP 56-48938A, published May 2, 1981",7 pgs.
"International Application Serial No. PCT/IT2010/000124, International Search Report mailed Nov. 30, 2010", 3 pgs.
"International Application Serial No. PCT/IT2010/000124, Written Opinion mailed Nov. 30, 2010", 4 pgs.

*Primary Examiner* — Mark A Osele
(74) *Attorney, Agent, or Firm* — Schwegman Lundberg & Woessner, P.A.

(57) ABSTRACT

There is described a machine for applying labels on articles transferred by respective labelling units along a given path (P); each unit comprises a receiving member having a lateral wall, which is adapted to receive a relative label and extends along an axis (F) transversal to the path (P); a cam and tappet device axially displaces the receiving members between a lowered position and a raised position and comprises a cam device, which is adjustable between a first and a second configuration; in the first configuration, cam followers of the units move along a first track (R) of the cam device to displace the respective receiving members between the lowered and raised position during transfer of the respective units; in the second configuration, the cam followers move along a second track (Q) of the cam device to maintain the respective receiving members in the lowered position during movement of the units along their path (P).

16 Claims, 6 Drawing Sheets

LABELLING MACHINE

PRIORITY CLAIM AND RELATED APPLICATIONS

This application is a nationalization under 35 U.S.C. 371 of PCT/IT2010/000124, filed Mar. 22, 2010, and published as WO 2011/117895 A1 on Sep. 29, 2011; which application and publication are incorporated herein by reference in their entirety.

TECHNICAL FIELD

The present invention relates to a labelling machine for applying labels on respective articles, such as bottles or generic containers, which the following description will refer to, although this is in no way intended to limit the scope of protection as defined by the accompanying claims.

BACKGROUND ART

As it is generally known, labelling machines are used to apply labels to containers or articles of all sort. Typically, for beverage bottles or vessels, two alternative techniques can be provided to attach the labels on the external surface of respective bottles. According to a first technique, the back surfaces of the labels (commonly called "roll labels") are covered with glue and are stuck onto the external surfaces of the bottles. According to a second technique, after having placed tubular labels made of heat-shrinkable film (commonly called "sleeve labels") around respective bottles, the tubular labels are heated to fit and adhere onto the bottles.

In particular, these tubular labels are obtained by:

- cutting a web unwound from a supply roll into a plurality of rectangular or square labels;
- bending each label in a cylindrical configuration such that the opposite vertical edges overlap one another; and
- welding the overlapped edges of each cylindrical label.

A particular type of labelling machine is known which serves to bend and weld labels in a tubular configuration and then to produce insertion of the bottles into the so formed tubular labels before the heating operation. This kind of machine basically comprises a carousel rotating about a vertical axis to define a circular path, along which it receives a succession of unlabelled bottles by a bottle input wheel and, then, a succession of rectangular or square labels by a label input wheel, produces application of the labels in a tubular configuration onto the respective bottles, and releases the labelled bottles to an output wheel.

More specifically, the carousel comprises a plurality of labelling units which are equally spaced along a peripheral edge of the carousel and are moved by the latter along the above-mentioned circular path.

Each labelling unit comprises a supporting assembly adapted to support the bottom wall of a relative bottle and an upper retainer adapted to cooperate with the top portion of such bottle, to hold it in a vertical position during the rotation of the carousel about its vertical axis.

Each supporting assembly comprises a vertical hollow supporting mount, secured to a horizontal plane of a rotary frame of the carousel; and a cylindrical receiving member, which engages the supporting mount in sliding and rotating manner with respect to its vertical axis, and is adapted to carry a relative bottle on its top surface and a relative label on its lateral surface.

The receiving members are displaced by a cam and tappet device between a raised position and a lowered position, while moving along the above mentioned circular path.

In the lowered position, the receiving member is fully retracted within the relative supporting mount, so that the top surface of each receiving member is flush with the top surface of the supporting mount. At the output wheel and at the bottle input wheel, each receiving member is located in its lowered position, so that the bottles are transferred onto and from the carousel along the same transfer horizontal plane.

In the raised position, each receiving member protrudes from a top surface of the relative supporting mount and is adapted to receive a relative label on its lateral surface from the label input wheel; in particular, the label is wrapped around the receiving member such that the opposite vertical edges of the label overlap one another. In order to produce this complete wrapping, the receiving member is rotated about its vertical axis during the transfer of the label from the label input wheel. The label is retained on the lateral surface of the receiving member by suction; for this purpose, at least a region of the lateral surface of the receiving member is provided with a plurality of holes, which are connected to a pneumatic suction device.

After having welded the overlapping edges of the tubular label, the suction is released and the receiving member is lowered, so as to produce the insertion of the relative bottle downwards inside the tubular label, therefore making the ensemble of the bottle and the surrounding label ready to be transferred to the output wheel.

The known labelling machines of this kind, working with the so-called "sleeve labels", are not suitable to work also with the so-called "roll labels", because the latter have to be stuck to the external surfaces of the bottles without providing vertically movable receiving members, i.e. without vertically moving the bottles. Indeed, in carousels provided to support and transfer bottles onto which labels are applied by means of glue, the supporting assemblies of the labelling units are simplified in comparison to the above described ones.

A need is felt to provide a single machine that can be configured by means of a relatively low number of operations to apply either the so-called "sleeve labels" or the so-called "roll labels", without removing or changing components from all the labelling units of the carousel.

OVERVIEW

Examples provide a labelling machine, which allows to meet the above mentioned needs in a straightforward and low-cost manner.

Such examples are claimed in claim 1.

BRIEF DESCRIPTION OF THE DRAWINGS

A non-limiting embodiment of the present invention will be described by way of example with reference to the accompanying drawings, in which.

DETAILED DESCRIPTION

Figure 1:
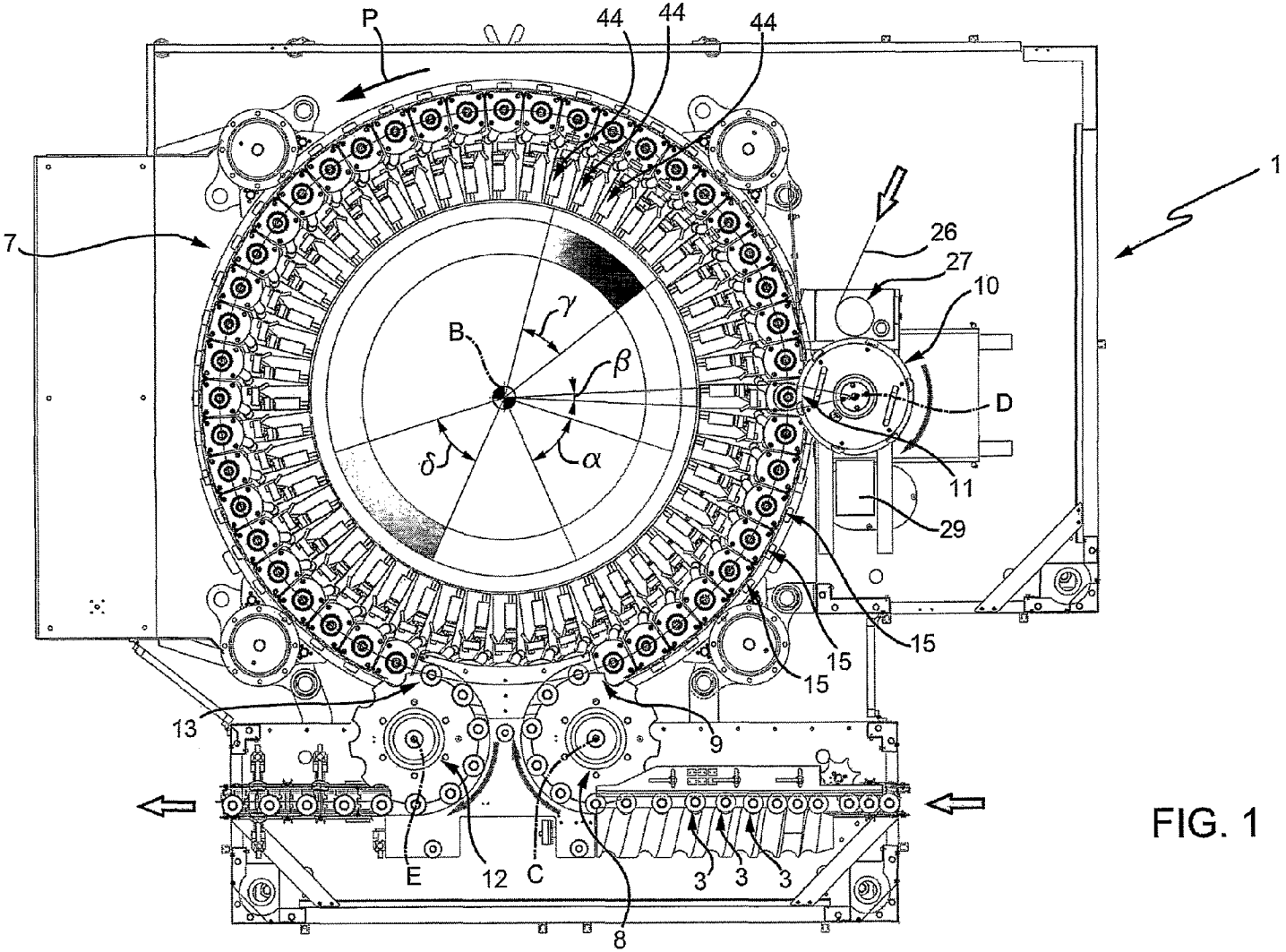
FIG. 1 shows a schematic plan view, with parts removed for clarity, of a labelling machine in accordance with the teachings of the present subject matter.

Number 1 in FIG. 1 indicates as a whole a labelling machine for applying labels 2 (shown with a grey shadow in FIGS. 2 and 3) to respective articles or more specifically containers, particularly bottles 3, each of which (FIGS. 1 to 3) extends along a longitudinal axis A, comprises a bottom wall 4 substantially perpendicular to axis A, and has a top neck 5 substantially coaxial with axis A.

Machine 1 comprises a conveying device that serves to bend and weld labels 2 in a tubular configuration (FIG. 3) and to produce insertion of bottles 3 downwards into the so formed tubular labels 2.

Figure 2:
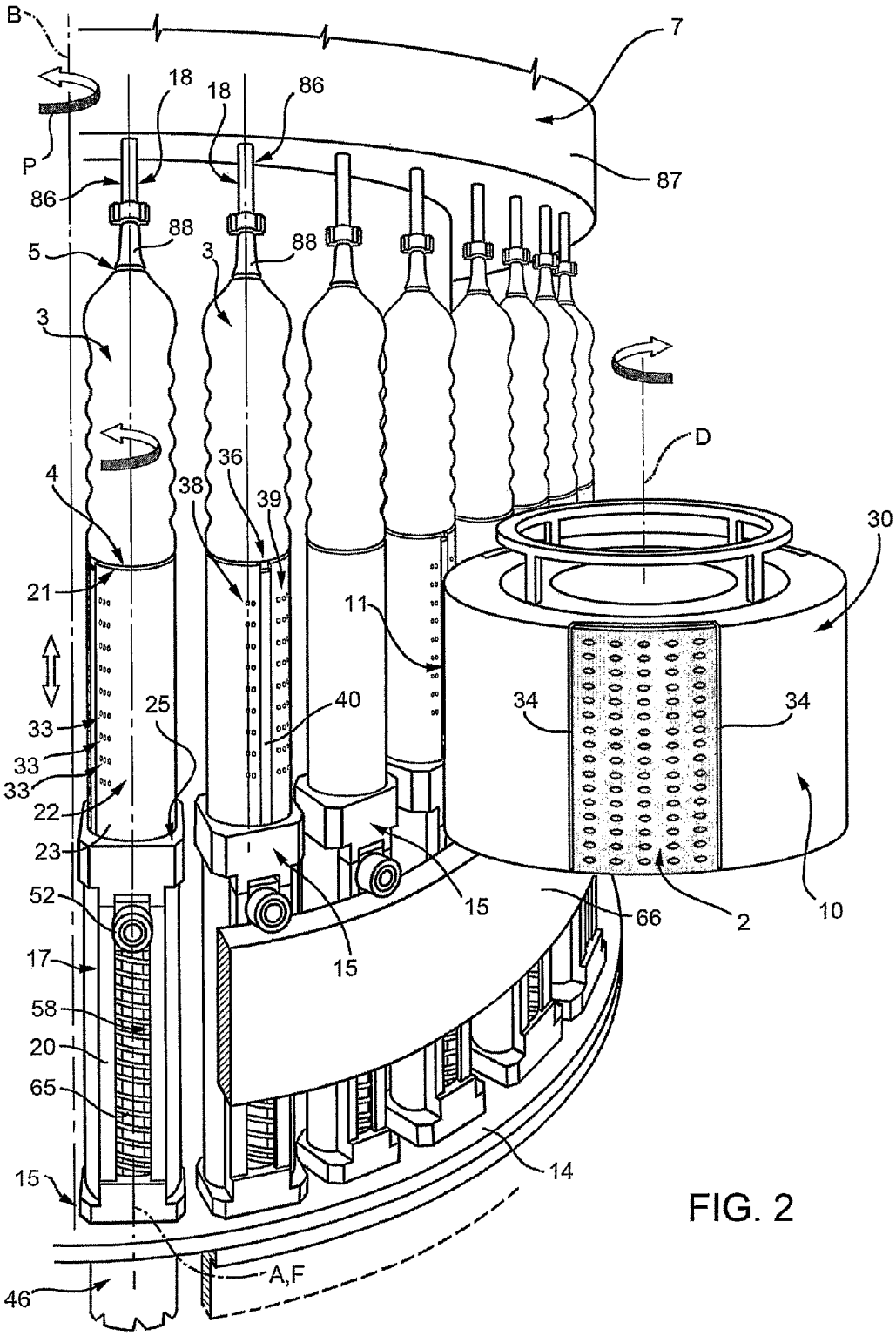
FIGS. 2 and 3 are larger-scale and partial views in perspective of the labelling machine of FIG. 1, in proximity of a label transfer station.
Figure 3:
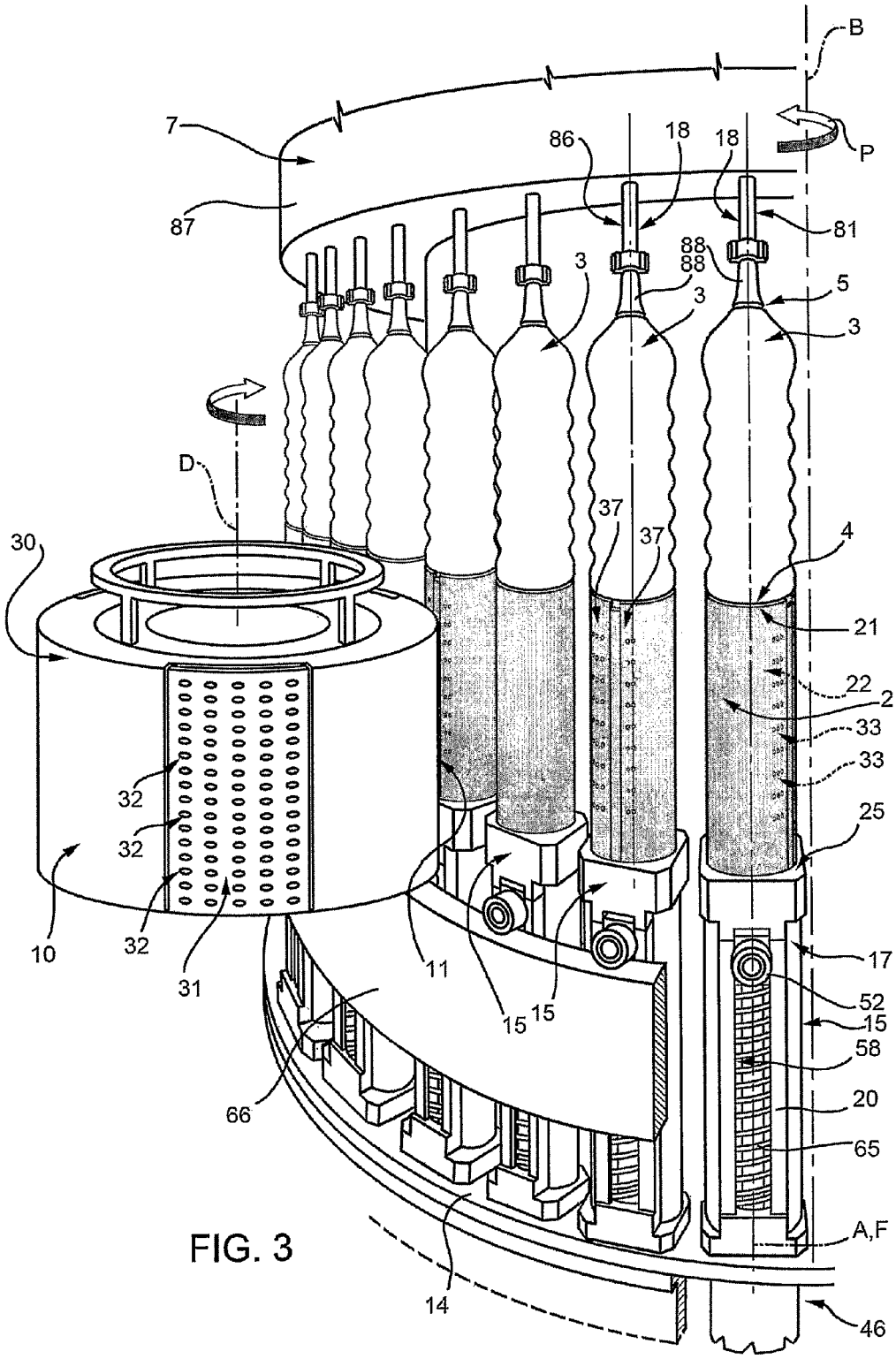

In the embodiment as illustrated on the FIGS. 1 to 3, the conveying device comprises a carousel 7, which is mounted to rotate continuously (anticlockwise in FIG. 1) about a respective vertical axis B perpendicular to the FIG. 1 plane.

The carousel 7 receives a succession of unlabelled bottles 3 from an input wheel 8, which cooperates with carousel 7 at a transfer station 9 and is mounted to rotate about a respective longitudinal axis C parallel to axis B. The rotation of the input wheel 8 is continuous and synchronized with the rotation of carousel 7.

The carousel 7 also receives a succession of rectangular or square labels 2 from an input drum 10, which cooperates with carousel 7 at a feeding station 11 and is mounted to rotate continuously about a respective longitudinal axis D parallel to axes B and C.

The carousel 7 releases a succession of labelled bottles 3 to an output wheel 12, which cooperates with carousel 7 at a transfer station 13 and is mounted to rotate about a respective longitudinal axis E parallel to axes B, C and D. The rotation of the output wheel 12 is continuous and synchronized with the rotation of carousel 7.

The carousel 7 comprises a plurality of operating or labelling units 15, which are equally spaced about axis B, are mounted along a peripheral edge of carousel 7, and are moved by carousel 7 along a circular path P extending about axis B and through transfer stations 9, 11 and 13. As shown in FIG. 1, transfer station 11 is arranged, along path P, downstream of transfer station 9 and upstream of transfer station 13.

With reference to FIGS. 2 and 3, the units 15 are secured to a horizontal rotary table 14 of carousel 7, have respective axes F parallel to axes B, C, D, E and extend coaxially through respective holes (not shown) of the rotary table 14 and on both sides of such table.

Each unit 15 is adapted to receive a relative bottle 3 from input wheel 8 in a vertical position, i.e. coaxially with the relative axis F, and to hold said bottle 3 in such position along path P from transfer station 9 to transfer station 13.

Units 15 being identical to each other, only one is described below for the sake of simplicity and clarity; it is clear that the features described hereafter are common to all the labelling units 15.

In particular, unit 15 comprises, above the rotary table 14 of carousel 7, a supporting assembly 17 adapted to support the bottom wall 4 of the relative bottle 3 and an upper retainer 18 adapted to cooperate with the top neck 5 of the bottle 3.

In particular, supporting assembly 17 comprises:

- a hollow supporting mount 20, which extends along axis F and is secured to a top surface of rotary table 14 around the relative hole thereof; and
- a hollow receiving member 22, engaging the supporting mount 20 in sliding and rotating manner with respect to axis F, having a top end adapted to support coaxially a relative bottle 3 and comprising a cylindrical lateral wall 23 adapted to carry a relative label 2 on its outer surface.

More specifically, the top end of the receiving member 22 is defined by a support plate 21, on which the bottle 3 rests. The support plate 21 is carried by a top portion of the lateral wall 23 via the interposition of a bearing (not visible), so as to be angularly free from lateral wall 23. In this way, rotational movements of the lateral wall 23 about axis F are not transmitted to the bottle 3.

Receiving member 22 can be moved along axis F between a lowered position and a raised position by means of a cam and tappet device 24, which will be described later in greater detail. In the lowered position, the receiving member 22 is completely retracted within the supporting mount 20, so that support plate 21 is substantially flush with a top surface 25 of the supporting mount 20. In the raised position, receiving member 22 protrudes from the top surface 25 of the supporting mount 20 and is adapted to receive, on the outer surface of its lateral wall 23, a label 2 made of heat-shrinkable film material from the input drum 10.

More specifically, with reference to FIG. 1, labels 2 are cut in a know manner from a web 26 by a cutting device 27 (schematically shown) and fed to the input drum 10, which in turn feeds the cut labels 2 to the carousel 7. According to the present subject matter, machine 1 can work to apply two alternative kinds of labels 2 onto the bottles 3. According to a first labelling technique, as mentioned above, labels made of heat-shrinkable film material are fed by the input drum 10, respectively, onto the lateral walls 23 of the receiving members 22, while the latter are located in the raised position. According to a second labelling technique, labels 2 having glue on their back surfaces are fed by the input drum 10 directly onto the lateral surfaces of respective bottles 3, while the receiving members 22 are maintained in their lowered position. In the latter case, in particular, back surfaces of cut labels 2 receive glue from a glue dispenser or glue applicator 29 (schematically shown), while front surfaces of cut labels 2 rest against a lateral surface 30 of the input drum 10. The horizontal position of the input drum 10 with respect to the carousel 7 is adjusted when the labelling technique has to be changed, in order to bring input drum 10 closer to axes F when glued labels have to be applied onto the lateral surfaces of the bottles 3 or to move input drum away when heat-shrinkable labels have to be wrap around the respective receiving members 22.

As shown in FIGS. 2 and 3, independently from the kind of labels 2 to be applied, front surfaces of cut labels 2 are retained on the lateral surface 30 by suction; in particular, the lateral surface 30 is divided into a given number, three in the embodiment shown, of suction regions 31, which are equally spaced about axis D, are each provided with a plurality of through holes 32 connected to a pneumatic suction device (known per se and not shown) and are adapted to cooperate with respective labels 2.

In an analogous manner (FIG. 2), lateral wall 23 of each receiving member 22 is provided with a plurality of through holes 33, in turn connected to a pneumatic suction device (not shown) so as to retain the relative label 2 made of heat-shrinkable film material on its outer surface by suction.

At the transfer station 11, lateral wall 23 of each receiving member 22 is rotated about the relative axis F in order to produce the complete wrapping of the relative label 2, coming from input drum 10, on its outer surface. In particular, each label 2, fed by input drum 10, is wrapped around the relative receiving member 22 so as to form a cylinder with the opposite vertical edges 34 overlapped one another.

More specifically, holes 33 extend only on a given portion 36, hereafter referred to as "suction portion", of lateral wall 23. Suction portion 36 has an arc-shaped cross section along a plane orthogonal to axis F and is sized in the circumferential direction so as to cooperate with two portions 37 of the relative label 2, which are adjacent, respectively, to the vertical edges 34.

In greater detail, suction portion 36 is divided into two distinct vertical regions 38, 39 by an elastically deformable, vertical strip pad 40, on which vertical edges 34 of a relative label 2 are placed in an overlapped configuration.

Figure 4:
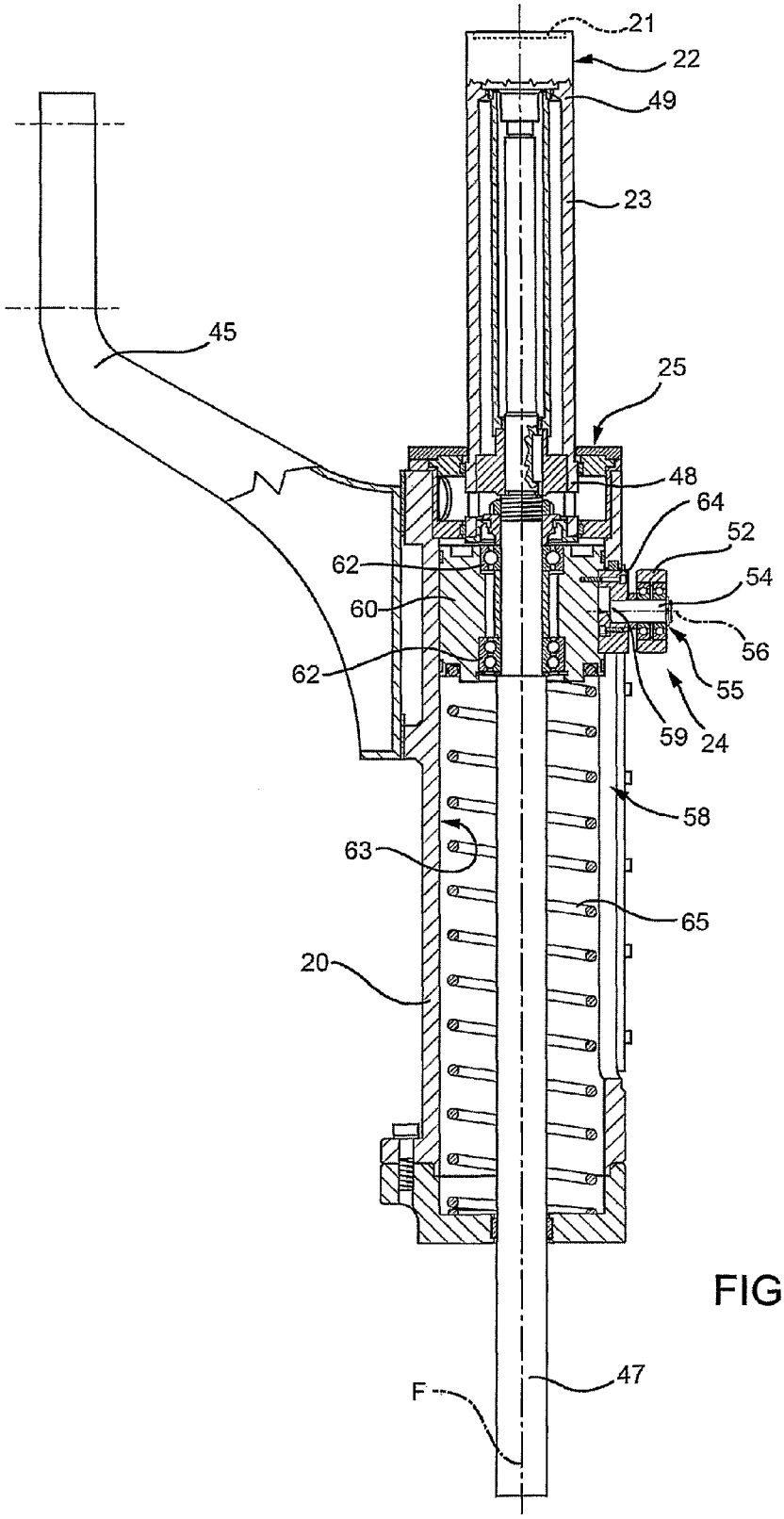
FIG. 4 shows a section, along a vertical section plane and with parts removed for clarity, of a labelling unit of the labelling machine of FIGS. 1-3.

Strip pad 40 defines, in a known manner, the contrasting element for a welding device 44 (known per se and only schematically shown in FIG. 1), arranged in front of, and in a radially inner position than, lateral wall 23 of receiving member 22 and adapted to weld the overlapped edges 34 of the relative label 2 so as to produce a tubular configuration of such label. In particular, each welding device 44 is coupled in fixed position to the supporting mount 20 of the relative unit 15 by means of a bracket 45 (FIG. 4).

Regions 38, 39 are located on opposite sides of strip pad 40. Holes 33 communicate with the above mentioned pneumatic suction device through an inner space of the receiving member 22 and through an inner space in a top portion 42 of the supporting mount 20 (FIG. 4). The inner spaces of the receiving member 22 and the top portion 42 communicate with each other in a manner not shown.

In the light of the above, receiving member 22, during travel of the relative unit 15 along path P, is subjected to distinct movements in different operative steps of the labelling machine 1:

- receiving member 22 is displaced along axis F from the lowered position to the raised position, after a bottle 3 has been transferred to unit 15;
- lateral wall 23 is rotated about axis F to receive a relative label 2 from input drum 10 and to allow bending of such label 2 in the cylindrical configuration; and
- receiving member 22 is displaced from the raised position to the lowered position to allow insertion of the bottle 3 downwards within the label 2 that has been welded in the tubular configuration.

With reference to FIG. 4, these movements are obtained by means of a driving shaft 47, which is coaxial with the receiving member 22, extends through the supporting mount 20 and the receiving member 22 and is coupled in fixed position to bottom and top portions 48, 49 of the receiving member 22 in a manner not described in detail. Therefore, driving shaft 47 and lateral wall 23 of receiving member 22 are axially and angularly fixed to each other, so that any displacement transmitted to driving shaft 47 results in a corresponding displacement of lateral wall 23.

Rotation of the driving shaft 47 is synchronized with the rotation of the input drum 10 and with the rotation of the carousel 7 and is operated by an actuator (schematically shown in FIGS. 2 and 3), which is carried by the rotary table 14, is arranged underneath rotary table 14 and, in particular, is secured to a bottom surface of the rotary table 14.

Vertical displacement of the driving shaft 47 is operated by the cam and tappet device 24 independently from the rotation operated by the actuator 46. The cam and tappet device 24 comprises a cam device 51 (FIG. 5) and, for each unit 15, a relative cam follower 52, which is defined, in particular, by a roller located outside of the supporting mount 20 and mounted on an outer end portion 54 of a supporting pin 55, so as to be axially fixed and freely rotatable with respect to an axis 56 of the supporting pin 55. Supporting pin 55 extends radially with respect to axes B and F through a slot 58, which is made in a lateral wall of the supporting mount 20 on the outer side with respect to axis B, i.e. on the side opposite to welding device 44 and bracket 45. Supporting pin 55 has an end portion 59 axially opposite to end portion 54 and fixed with respect to a collar 60. Collar 60 is coaxial with driving shaft 47 and is coupled to driving shaft 47 by means of bearings 62, so as to be angularly free from driving shaft 47 and lateral wall 23 and to be axially fixed with respect to driving shaft 47 and lateral wall 23. Besides, collar 60 has an outer lateral surface slidingly coupled to the inner surface 63 of the supporting mount 20, so as to be axially guided between an upper position and a lower position.

In particular, end portion 59 is coupled to collar 60 by means of an annular element 64, which is fastened to supporting pin 55 and to a side portion of collar 60, and is guided by slot 58 in a direction parallel to axis F. Therefore, slot 58 defines a constraint that prevents collar 60 and cam follower 52 from rotating about axis F. Therefore, any displacement transmitted to cam follower 52 results in an axial displacement of the driving shaft 47 and receiving member 22 between the lowered and raised positions. A spring 65 is provided inside the supporting mount 20 to push collar 60 upwards and, therefore, avoid axial play during displacement of cam follower 52.

Figure 5:
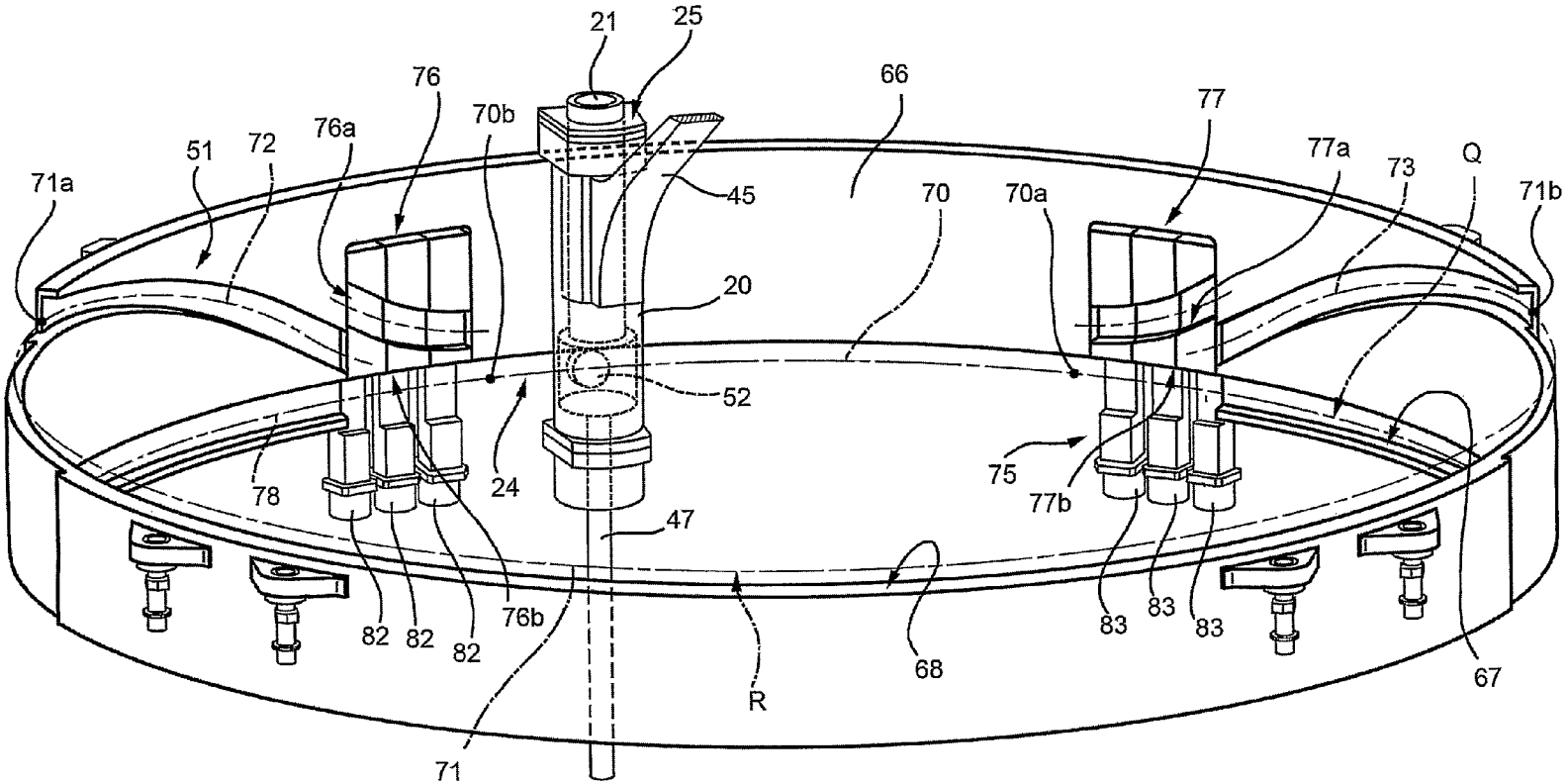
FIG. 5 shows a larger-scale view in perspective, with parts removed for clarity, of a configurable cam and tappet device of the labelling machine of FIGS. 1-3.

With reference to FIG. 5, the cam device 51 is defined by an annular structure 66, which is fixed and extends along path P around the units 15 that are transferred by carousel 7. Cam device 51 can be adjusted to be set in a first configuration, in which cam followers 52 move along a track R, or in a second configuration, in which cam followers move along a track Q. In particular, cam device 51 comprises two cams 67,68, which alternately can be engaged by cam followers 52 and define, respectively, the tracks Q,R.

Track Q of cam 67 is used to perform the second labelling technique, is parallel to the circular path P of the units 15 and lies on a horizontal plane, i.e. a plane perpendicular to axis B, in order to maintain all the engaging cam followers 52 at a given height, that corresponds to the lowered position of the receiving members 22.

On the other hand, track R of cam 68 is shaped so as to move the cam followers 52 along the respective slots 58 to perform lifting and lowering of the respective receiving members 22 when machine 1 is used according to the first labelling technique. FIG. 1 shows the rotation angles of the carousel 7 about axis B when such first labelling technique is performed: angle $\alpha$ refers to the lifting movement of the receiving members 22 from the lowered position to the raised position, angle $\beta$ refers to the label transfer from the input drum 10 to the receiving members 22, angle $\gamma$ refers to the welding operation on the overlapped edges 34 of the tubular labels 2, and angle $\delta$ refers to the downward movement of the receiving members 22 to produce insertion of the bottles 3 within the corresponding tubular labels 2. Track R comprises:

- an arc portion 70, which is in common with track Q, is located between transfer stations 13 and 9, and has a beginning point 70*a* corresponding to the end of angle $\delta$ and an end point 70*b* corresponding to the beginning of angle $\alpha$;
- an arc portion 71, which is parallel to path P, has a beginning point 71*a* corresponding to the end of angle $\alpha$ and an end point 71*b* corresponding to the beginning of angle δ, and is at an higher height with respect to arc portion 70, the difference in height between arc portions 71 and 70 being equal to the stroke of the receiving members 22 along the respective axes F;

a lifting slope or ramp 72, which joins point 70*b* to point 71*a* and corresponds to angle α;

a lowering slope or ramp 73, which joins point 71*b* to point 70*a* and corresponds to angle δ.

Cam and tappet device 24 comprises a selection device 75 to set cam device 51 in the first or the second configuration. Selection device 75 comprises two switch devices 76, 77 located, respectively, at points 70*b* and 70*a*, i.e. where ramps 72,73 meet track Q: switch device 76 comprise at least one element that can be moved in two positions, to deviate the cam followers 52 arriving from portion 70 into ramp 72 or, respectively, into a remaining portion 78 of track Q; analogously switch device 77 comprise at least one element that can be moved in two positions, to channel cam followers 52 from ramp 73 or, respectively, from portion 78 into portion 70.

In particular, the movement of the element or, the elements, of switch device 76 set one of two guides 76*a*,76*b* at point 70*b*; analogously, the movement of the element or, the elements, of switch device 77 set one of two guides 77*a*,77*b* at point 70*a*.

In the first configuration, guides 76*a* and 77*a* join portion 70 to ramps 72,73; in the meantime, guides 76*b* and 77*b* are located out of path R, in particular under cams 67,68, so as not to be engaged by cam followers 52. In the second configuration (FIG. 5), guides 76*b* and 77*b* join portion 70 to portion 78; in the meantime, guides 76*a* and 77*a* are located out of path Q, in particular over cam 67, so as not to be engaged by cam followers 52.

Switch device 76, 77 comprise respective actuators 82, 83, located beneath cam 67, controlled to move the above-mentioned movable elements and select guide 76*a* or 76*b* and, respectively, select guide 77*a* or 77*b*. In particular, elements of switch devices 76 are three in number, are indicated by reference numbers 80*a*,80*b*, 80*c*, are arranged side by side along a direction parallel to track Q and path P, and are symmetrical to elements 81*c*,81*b*,81*a* of switch device 77, with respect to a halfway plane on which axis B lies. Elements 80*a*,80*b*,80*c* and elements 81*a*,81*b*,81*c* can slide along directions parallel to axes B and F under the action of the actuators 82,83. Each of elements 80*a*,80*b*,80*c* comprises a relative portion of guide 76*a* and a relative portion of guide 77*a*. Analogously, each of elements 81*a*,81*b*,81*c* comprises a relative portion of guide 76*b* and a relative portion of guide 77*b*.

FIG. 6*a*-6*h* schematically show a sequence of steps to adjust the cam device 51 from the first configuration to the second configuration, with a step-by-step rotating movement of the carousel 7. The first cam follower 52*a* to be deviated into track Q is shown in grey shadow, for sake of clarity. The width of elements 80*a*,80*b*,80*c*,S1*a*,81*b*,S1*c* is equal to half the pitch between the cam followers 52, and is higher than the diameter of each cam follower 52.

Figure 6A:
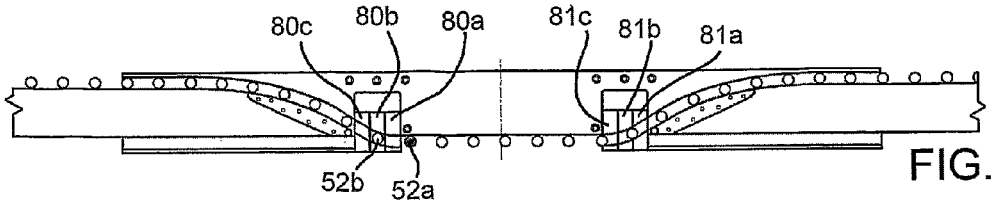
FIGS. 6*a*-6*h* schematically show a sequence of operations to set the cam and tappet device of FIG. 5 from a first configuration to a second configuration.
Figure 6B:
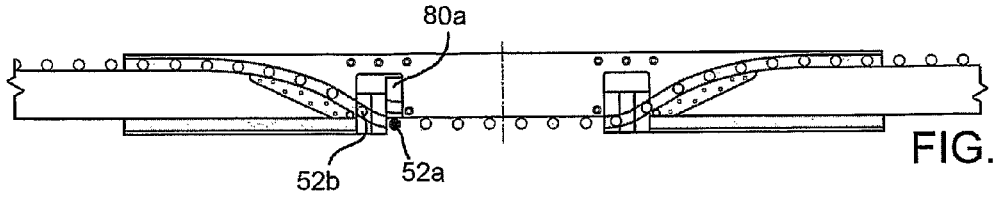
Figure 6C:
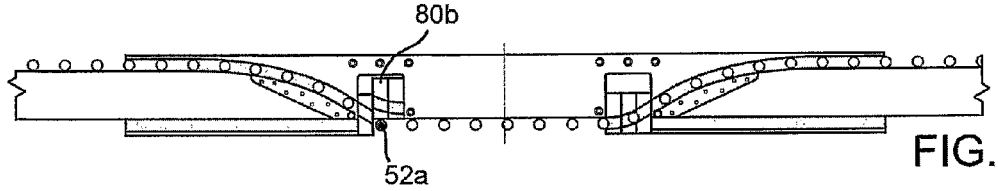
Figure 6D:
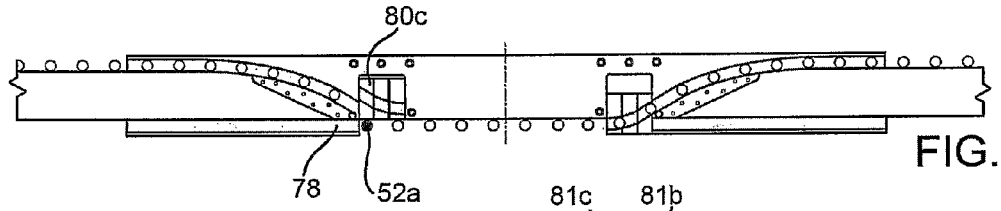
Figure 6E:
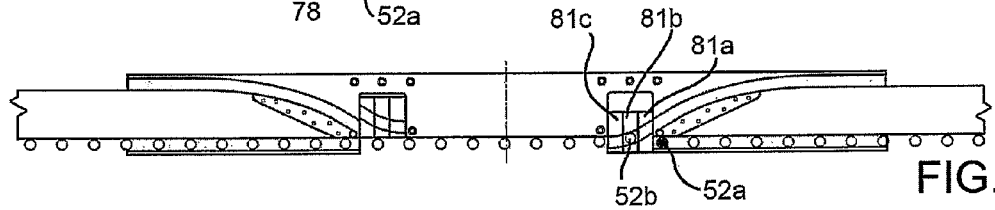
Figure 6F:
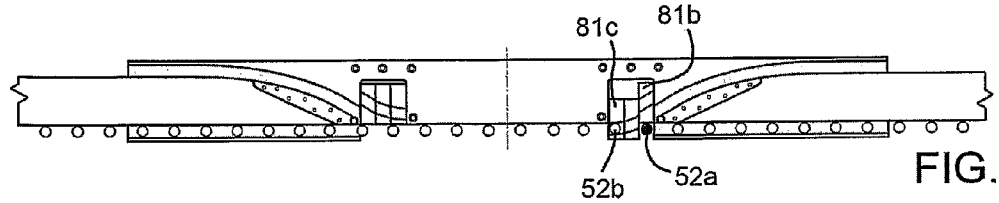
Figure 6G:
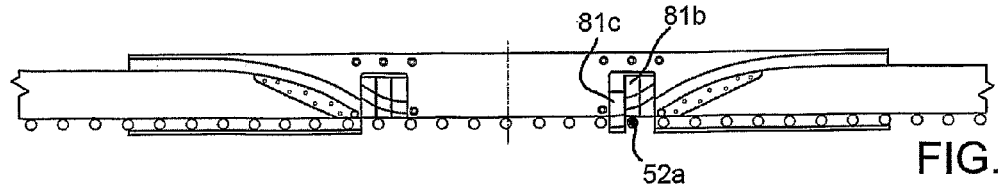

When the last cam follower 52*b* to be deviated into track Q engages the second element 80*b*, the first element 80*a* and the third element 80*c* are void (FIG. 6*a*). In this condition, the first element 80*a* is switched to remove guide 76*a* and set guide 76*b*. Therefore, cam follower 52*a* enters into guide 76*b* of the first element 80*a* to begin to follow track Q. In the meantime, cam follower 52*b* engages guide 76*a* of the third element 80*c* to still follow track R, and the second element 80*b* becomes void (FIG. 6*b*). At this point, the second element 80*b* is switched to remove guide 76*a* and set guide 76*b*, to allow cam follower 52*a* to follow guide 76*b* of the second element 80*b* (FIG. 6*c*). In this condition, the third element 80*c* becomes void and is then switched to remove guide 76*a* and set guide 76*b*. In this way, cam follower 52*a* follows guide 76*b* of the third element 80*c* (FIG. 6*d*) and afterwards portion 78 of track Q.

Figure 6H:
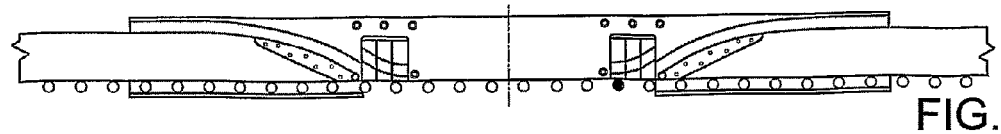

When cam follower 52*a* is at the end of portion 78 (FIG. 6*e*), cam follower 52*b* engages guide 77*a* the second element 81*b*, and the first element 81*a* and the third element 81*c* are void. In this condition, the first element 81*a* is switched to remove guide 77*a* and set guide 77*b*. When cam follower 52*a* engages guide 77*b* of the first element 81*a* (FIG. 6*f*), cam follower 52*b* engages guide 77*a* of the third element 81*c*. In the meantime, the second element 81*b* is void and can be switched to remove guide 77*a* and set guide 77*b*. Finally, when cam follower 52*a* engages guide 77*b* of the second element 81*b* (FIG. 6*g*), the third element 81*c* becomes void and is then switched to remove guide 77*a* and set guide 77*b*. FIG. 6*h* shows the instant when the second configuration of the cam device 51 is completely reached, as in FIG. 5.

A change of the cam device 51 from the second configuration to the first configuration can be performed in an analogous manner, by switching elements 80*a*,80*b*,80*c* and 81*a*, 81*b*,81*c* in sequence to progressively set guide 76*a* instead of guide 76*b* and progressively set guide 77*a* instead of guide 77*b*.

Coming back now to FIGS. 2 and 3, the retainer 18, corresponding to the described supporting assembly 17, comprises, in a known manner, a cylindrical movable member 86, which protrudes vertically from an upper rotary portion 87 of carousel 7, can be displaced along the relative axis F and has a bell-shaped free end portion 88 adapted to cooperate with the top neck 5 of the bottle 3 carried by such supporting assembly 17.

More specifically, the axial displacements of each movable member 86 are controlled in a known manner so as to maintain the same distance between its end portion 88 and the corresponding plate 21, during the movement of the relative unit 15 along path P from transfer station 9 to transfer station 13, independently of the vertical displacement of the receiving member 22 between the lowered and the raised positions, and so as to increase such distance at transfer stations 9, 13. In this way, bottles 3 are securely hold in their vertical positions during the travel from station 9 to station 13 and are free to be transferred at such stations 9 and 13 from input wheel 8 and to output wheel 12, respectively.

Operation of machine 1 will now be described with reference to the labelling of one bottle 3, and therefore to one labelling unit 15, according to the first labelling technique. Starting from the instant in which the receiving member 22 of unit 15 is located in the lowered position, within the relative supporting mount 20, the support plate 21 receives the unlabelled bottle 3 from input wheel 8. In this condition, the bottle 3, which rests on plate 21 carried by the receiving member 22, is hold in the vertical position by the combined action of the receiving member 22 and the relative upper retainer 18.

During the subsequent movement of unit 15 along path P (angle α in FIG. 1), ramp 72 of cam 68 moves the driving shaft 47 along axis F, so producing a translational movement of the receiving member 22 towards the desired raised position.

At the transfer station 11, the input drum 10 reaches an angular position around axis D adapted to put the label 2 into contact with the receiving member 22 passing through such station; in this condition (angle β), a pure rotational movement of lateral wall 23 about axis F is obtained by operating the actuator 46, to produce complete wrapping of the label 2 around such lateral wall 23 (FIG. 3).

When the label 2 reaches a cylindrical configuration with the opposite vertical edges 34 overlapped one another and arranged on strip pad 40, the label 2 is ready to be welded along the edges 34 by activation of the welding device 44 (angle γ).

During the last part of the path P (angle δ), ramp of cam 68 causes the receiving member 22 to return towards the lowered position within the relative supporting mount 20, so as to produce the insertion of the bottle 3 inside the so formed tubular label 2.

A heat-shrinking step (not shown) can be then performed on the bottles 3 exiting from the carousel 7 to obtain shrinking and adhesion of the label 2 to the bottle external surface.

When a change from the first to the second labelling technique is requested, the selection device 75 is operated to change configuration of the cam device 51. Accordingly, cam followers 52 change their track from cam 68 to cam 67, along one turn of carousel 7 about axis B. Once the second configuration is reached, receiving members 22 of units 15 remain in the lowered position, within the relative supporting mount 20, along all the path P. In this condition, it is possible to feed labels (called "roll-labels") made of a material different from heat-shrinkable film. In the meantime, glue dispenser or glue applicator 29 is activated to apply glue on the back surfaces of such labels 2, and the position of input drum 10 is adjusted to bring the back surface of labels 2 directly onto the outer surface of the respective bottles 3, without the need of the receiving members 22.

The advantages of machine 1 according to the present subject matter are clear from the above description. In particular, the cam device 51 permits to use the same machine 1 for processing either the so-called "roll 5 labels", to be covered with glue and to be stuck directly onto the external surfaces of the bottles 3, or the so called "sleeve labels", to be wrapped and shrunk around the bottles 3.

The change in the labelling technique only requires to operate the selection device 76 without dismantling and reassembling the cam and tappet device 24.

Clearly, changes may be made to labelling machine 1 and labelling units 15 as described and illustrated herein without, however, departing from the scope of protection as defined in the accompanying claims.

In particular, the number of elements 80,81 in each of switch devices 76,77, the width of elements 80,81 along track Q, and the movement of elements 80,81 with respect to structure 66 could be different from the ones envisaged by way of example.

The invention claimed is:

1. A labelling machine for applying labels to respective articles, said machine comprising:

at least one unit to receive and retain an article to be labeled; said unit comprising a receiving member, which extends along a vertical axis (F), is axially slidable between a raised position and a lowered position, is adapted to support a relative article, and comprises a lateral wall rotatable about said axis (F) and adapted to carry a relative label on its outer surface;

a conveying device to transfer said unit along a given path (P) transversal to said axis (F);

a feeding means having an outer lateral surface for feeding at least a label to said unit, said outer lateral surface configured to receive the label;

an actuating means for rotating said lateral wall about said axis (F) so as to wrap a fed label around said lateral wall when said receiving member is arranged in the raised position;

a welding device for welding the overlapped edges of the label wrapped about the lateral wall into a tubular label;

a cam and tappet device to axially displace said receiving member between said lowered and raised positions; said cam and tappet device comprising a cam device located in fixed position along said path (P), and a cam follower axially fixed with respect to said receiving member and engaging said cam device, wherein said cam device is adjustable between a first configuration, in which it defines a first track (R) for the cam follower, to cause the displacement of said receiving member between the lowered and raised position during movement of said unit along said path (P), and a second configuration, in which it defines a second track (Q) for the cam follower, to maintain said receiving member in said lowered position during movement of said unit along said path (P);

wherein said outer lateral surface of said feeding means is rotatable with the unit and adjacent to the lateral wall of the unit to feed a heat shrinkable label around the lateral wall of the unit while the cam device is in the first configuration and directly applies a label to the article retained by the unit while the cam device is in the second configuration; and wherein, in the first track (R), the unit is lowered from the raised position to the lowered position after the label is made into a tubular device by the welding device.

2. A labelling machine as claimed in claim 1, wherein said cam and tappet device comprise a selection device operable to select the track to be engaged by said cam follower and adapted to prevent the cam follower from engaging the non-selected track.

3. A labelling machine as claimed in claim 2, wherein said cam device comprises a first cam and second cam defining, respectively, said first and second tracks (R,Q) and having a track portion in common with each other.

4. A labelling machine as claimed in claim 3, wherein said selection device comprises a first and a second switch device, which are located at the points where said track portion ends and begins; said first and second switch devices comprise respective movable elements, which are movable to select the track to be followed by the cam follower.

5. A labelling machine according to claim 4, wherein at least one movable element of said first switch device define a couple of guides and is movable to locate one or the other of said guides at the end point of said track portion.

6. A labelling machine as claimed in claim 5, wherein said first switch device comprise three movable elements arranged side by side along a direction parallel to said path (P), and each defining respective portions of said guides; actuating means being controlled to move said three elements one after the other to progressively set the selected guide at the end point of said track portion during movement of said unit along said path (P).

7. A labelling machine according to claim 4, wherein at least one movable element of said second switch device define a couple of guides and is movable to locate one or the other of said guides at the beginning of said track portion.

8. A labelling machine as claimed in claim 7, wherein said second switch device comprise three movable elements arranged side by side along a direction parallel to said path (P), and each defining respective portions of said guides; actuating means being controlled to move said three elements one after the other to progressively set the selected guide at the beginning point of said track portion during movement of said unit along said path (P).

9. A labelling machine for applying labels to respective articles, said machine comprising:

at least one unit to receive and retain an article to be labeled; said unit comprising a receiving member, which extends along a vertical axis (F), is axially slidable between a raised position and a lowered position, is adapted to support a relative article, and comprises a lateral wall rotatable about said axis (F) and adapted to carry a relative label on its outer surface;

a conveying device to transfer said unit along a given path (P) transversal to said axis (F);

an input drum having an outer lateral surface feeding at least a label to said unit;

an actuator to rotate said lateral wall about said axis (F) so as to wrap a fed label around said lateral wall when said receiving member is arranged in the raised position;

a welding device for welding the overlapped edges of the label wrapped about the lateral wall into a tubular label;

a cam and tappet device to axially displace said receiving member between said lowered and raised positions; said cam and tappet device comprising a cam device located in fixed position along said path (P), and a cam follower axially fixed with respect to said receiving member and engaging said cam device, wherein said cam device is adjustable between a first configuration, in which it defines a first track (R) for the cam follower, to cause the displacement of said receiving member between the lowered and raised position during movement of said unit along said path (P), and a second configuration, in which it defines a second track (Q) for the cam follower, to maintain said receiving member in said lowered position during movement of said unit along said path (P);

wherein said outer lateral surface of said input drum is rotatable with the unit and adjacent to the lateral wall to feed a heat shrinkable label around the lateral wall of the unit while the cam device is in the first configuration and directly applies a label to the article retained by the unit while the cam device is in the second configuration; and wherein, in the first track (R), the unit is lowered from the raised position to the lowered position after the label is made into a tubular device by the welding device.

10. A labelling machine as claimed in claim 9, wherein said cam and tappet device comprise a selection device operable to select the track to be engaged by said cam follower and adapted to prevent the cam follower from engaging the non-selected track.

11. A labelling machine as claimed in claim 10, wherein said cam device comprise a first cam and second cam defining, respectively, said first and second tracks (R,Q) and having a track portion in common with each other.

12. A labelling machine as claimed in claim 11, wherein said selection device comprises a first and a second switch device, which are located at the points where said track portion ends and begins; said first and second switch devices comprise respective movable elements, which are movable to select the track to be followed by the cam follower.

13. A labelling machine according to claim 12, wherein at least one movable element of said first switch device define a couple of guides and is movable to locate one or the other of said guides at the end point of said track portion.

14. A labelling machine as claimed in claim 13, wherein said first switch device comprise three movable elements arranged side by side along a direction parallel to said path (P), and each defining respective portions of said guides; the actuator configured to be controlled to move said three elements one after the other to progressively set the selected guide at the end point of said track portion during movement of said unit along said path (P).

15. A labelling machine according to claim 14, wherein at least one movable element of said second switch device define a couple of guides and is movable to locate one or the other of said guides at the beginning of said track portion.

16. A labelling machine as claimed in claim 15, wherein said second switch device comprise three movable elements arranged side by side along a direction parallel to said path (P), and each defining respective portions of said guides; the actuator configured to be controlled to move said three elements one after the other to progressively set the selected guide at the beginning point of said track portion during movement of said unit along said path (P).

* * * * *